US007397360B2

(12) United States Patent
Corrington et al.

(10) Patent No.: US 7,397,360 B2
(45) **Date of Patent: *Jul. 8, 2008**

(54) REMOTE SPA MONITOR

(75) Inventors: Richard A. Corrington, Tustin, CA (US); Kurt A. Dykema, Holland, MI (US); David L. Klamer, Zeeland, MI (US); Brent K. Bouws, Holland, MI (US)

(73) Assignee: Balboa Instruments, Inc., Tustin, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/555,158

(22) Filed: Oct. 31, 2006

(65) Prior Publication Data

US 2007/0139194 A1 Jun. 21, 2007

Related U.S. Application Data

(63) Continuation of application No. 10/969,775, filed on Oct. 20, 2004, now Pat. No. 7,167,087.

(51) Int. Cl.
*G08B 26/00* (2006.01)

(52) U.S. Cl. ..... 340/505; 340/506; 340/539.1

(58) Field of Classification Search ..... 340/505, 340/506, 539.1, 539.26, 3.7; 700/275, 278, 700/282, 300; 392/465; 307/11, 42, 147
See application file for complete search history.

(56) References Cited

U.S. PATENT DOCUMENTS

| | | | | |
|---|---|---|---|---|
| 4,780,917 | A * | 11/1988 | Hancock | 4/541.2 |
| 5,559,720 | A * | 9/1996 | Tompkins et al. | 700/300 |
| 6,782,309 | B2 * | 8/2004 | Laflamme et al. | 700/275 |
| 7,167,087 | B2 * | 1/2007 | Corrington et al. | 340/505 |

* cited by examiner

*Primary Examiner*—Anh V. La
(74) *Attorney, Agent, or Firm*—Larry K. Roberts

(57) ABSTRACT

A method and apparatus for remotely monitoring a status of a spa installation includes transmitting status commands from a spa monitor to a spa installation over a communication link, and generating an alarm if status data is not returned via the link.

20 Claims, 11 Drawing Sheets

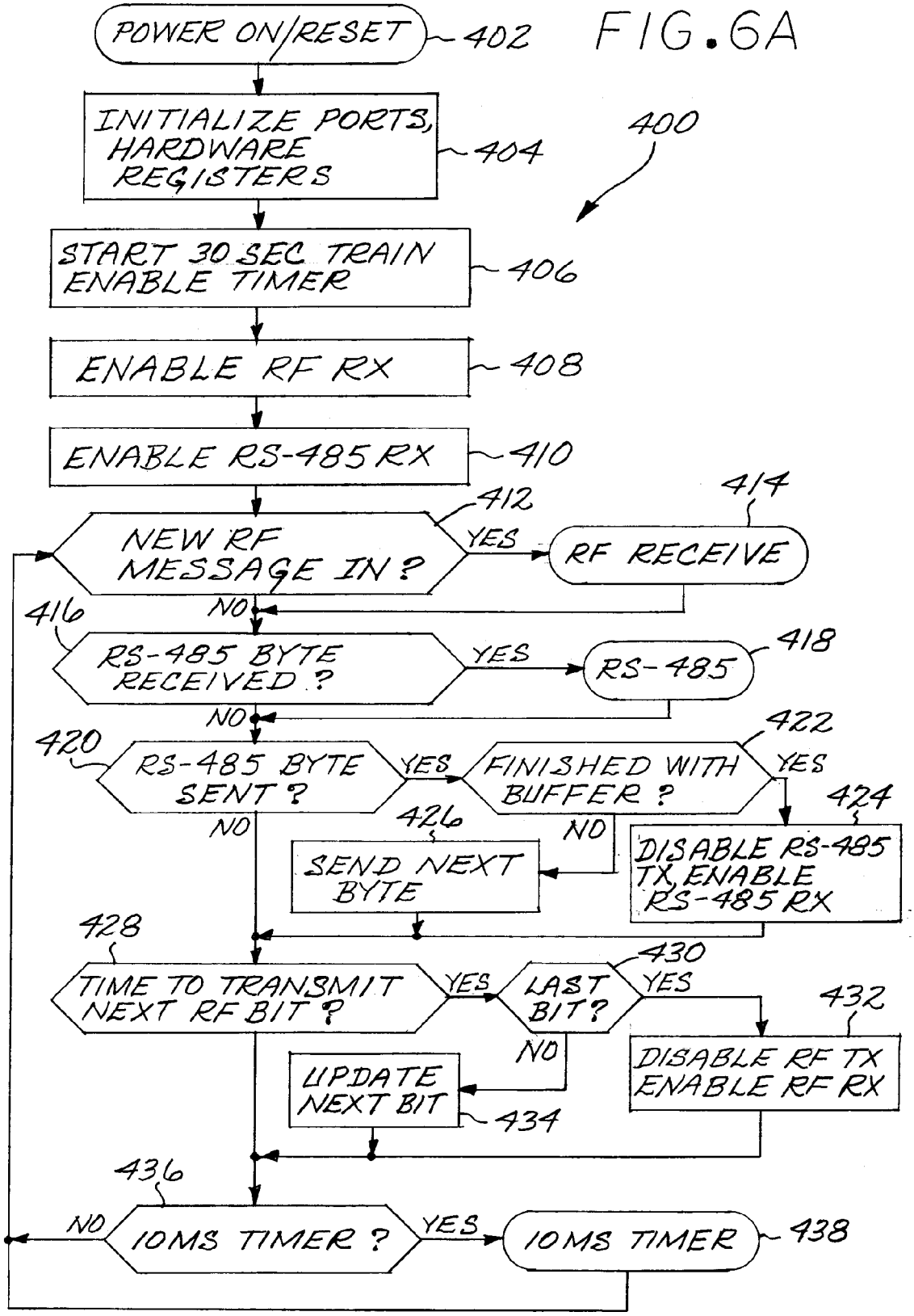
FIG. 6A
400
POWER ON/RESET
402
INITIALIZE PORTS, HARDWARE REGISTERS
404
START 30 SEC TRAIN ENABLE TIMER
406
ENABLE RF RX
408
ENABLE RS-485 RX
410
NEW RF MESSAGE IN ?
412
YES
RF RECEIVE
414
NO
RS-485 BYTE RECEIVED ?
416
YES
RS-485
418
NO
RS-485 BYTE SENT ?
420
YES
FINISHED WITH BUFFER ?
422
YES
NO
SEND NEXT BYTE
426
DISABLE RS-485 TX, ENABLE RS-485 RX
424
NO
TIME TO TRANSMIT NEXT RF BIT ?
428
YES
LAST BIT ?
430
YES
NO
UPDATE NEXT BIT
434
DISABLE RF TX ENABLE RF RX
432
10MS TIMER ?
436
NO
YES
10MS TIMER
438

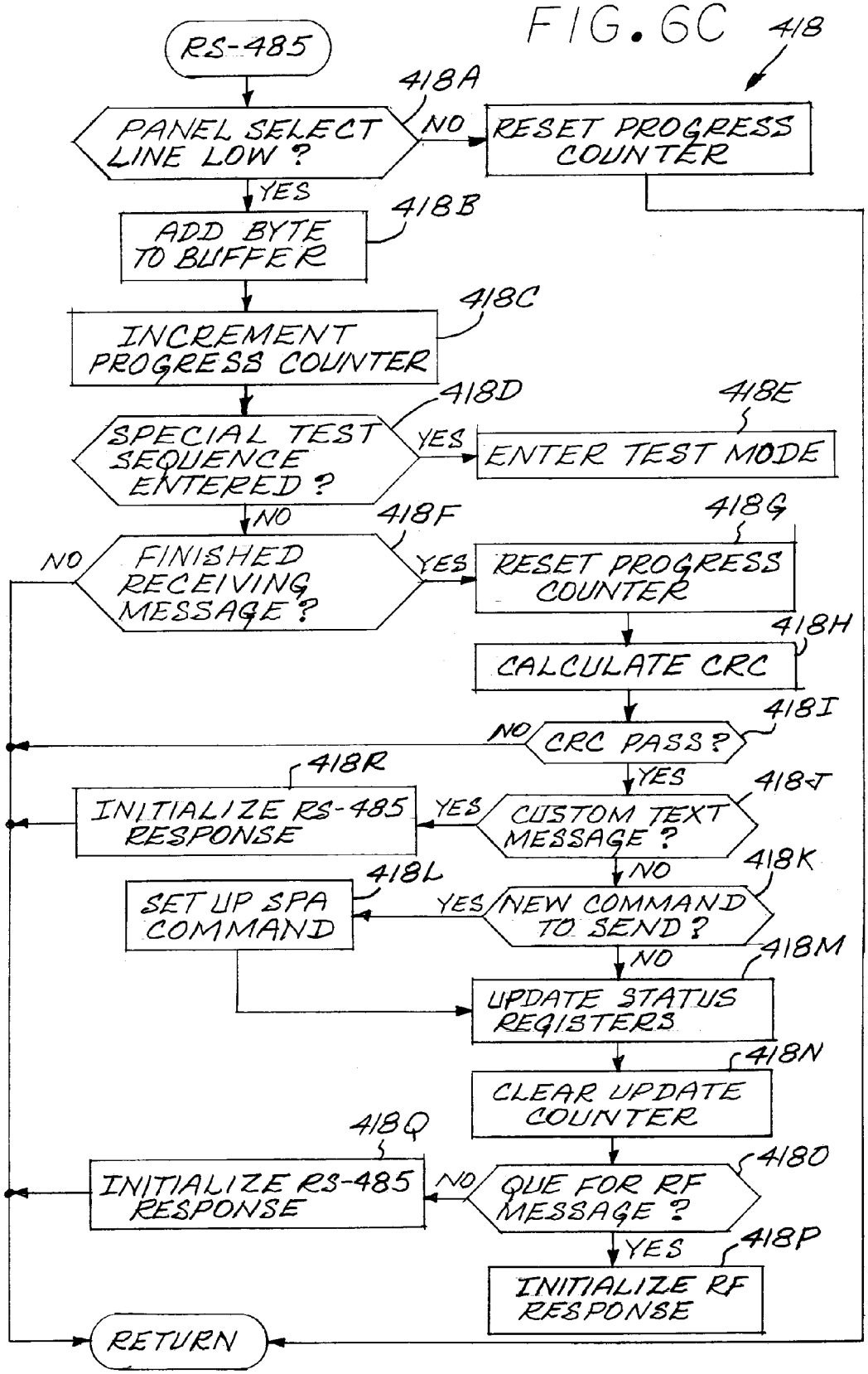
FIG. 6C
418
RS-485
418A
PANEL SELECT LINE LOW ?
NO
RESET PROGRESS COUNTER
YES
418B
ADD BYTE TO BUFFER
418C
INCREMENT PROGRESS COUNTER
418D
SPECIAL TEST SEQUENCE ENTERED ?
YES
418E
ENTER TEST MODE
NO
418F
FINISHED RECEIVING MESSAGE ?
NO
YES
418G
RESET PROGRESS COUNTER
418H
CALCULATE CRC
418I
CRC PASS ?
NO
YES
418R
INITIALIZE RS-485 RESPONSE
YES
418J
CUSTOM TEXT MESSAGE ?
NO
418K
NEW COMMAND TO SEND ?
YES
418L
SET UP SPA COMMAND
NO
418M
UPDATE STATUS REGISTERS
418N
CLEAR UPDATE COUNTER
418Q
INITIALIZE RS-485 RESPONSE
NO
418O
QUE FOR RF MESSAGE ?
YES
418P
INITIALIZE RF RESPONSE
RETURN

10 MS TIMER

438A
UPDATE "CHANGED MODE" TIMER
438
438B
UPDATE TIMER FOR TRACKING BUTTON COMMANDS
438C
UPDATE TIMER SINCE LAST RS-485 UPDATE
438D
>0.5S SINCE LAST UPDATE?
NO
YES
438E
RF RESPONSE IN QUE?
NO
YES
438F
INITIATE "NSG" RF MESSAGE
438G
100 COUNTS ?
YES
NO
438H
INCREMENT SECONDS TIMER
438I
RESET COUNTS
438K
DISABLE REMOTE CONTROL TRAINING
YES
438J
>30 SECONDS ?
NO
RETURN

REMOTE SPA MONITOR

CROSS-REFERENCE TO RELATED APPLICATION

This application claims priority from application Ser. No. 10/969,775, filed Oct. 20, 2004, now U.S. Pat. No. 7,167,087 the entire contents of which are incorporated herein by this reference.

BACKGROUND

Spas are a popular feature in homes as well as hotels and other establishments. Typically the spa is located outdoors, e.g. near an outdoor pool or in a stand alone location. When the spa is left unattended for extended periods of time, a failure or abnormal condition can occur which if not attended to by the spa owner or operator, may lead to undesirable conditions. For example, conditions can occur which might cause the spa to either freeze or overheat.

BRIEF DESCRIPTION OF THE DRAWINGS

Features and advantages of the disclosure will readily be appreciated by persons skilled in the art from the following detailed description when read in conjunction with the drawing wherein:

FIGS. 6A-6D are flow diagrams illustrating operation of an exemplary embodiment of a base station transceiver.

DETAILED DESCRIPTION

Figure 1:
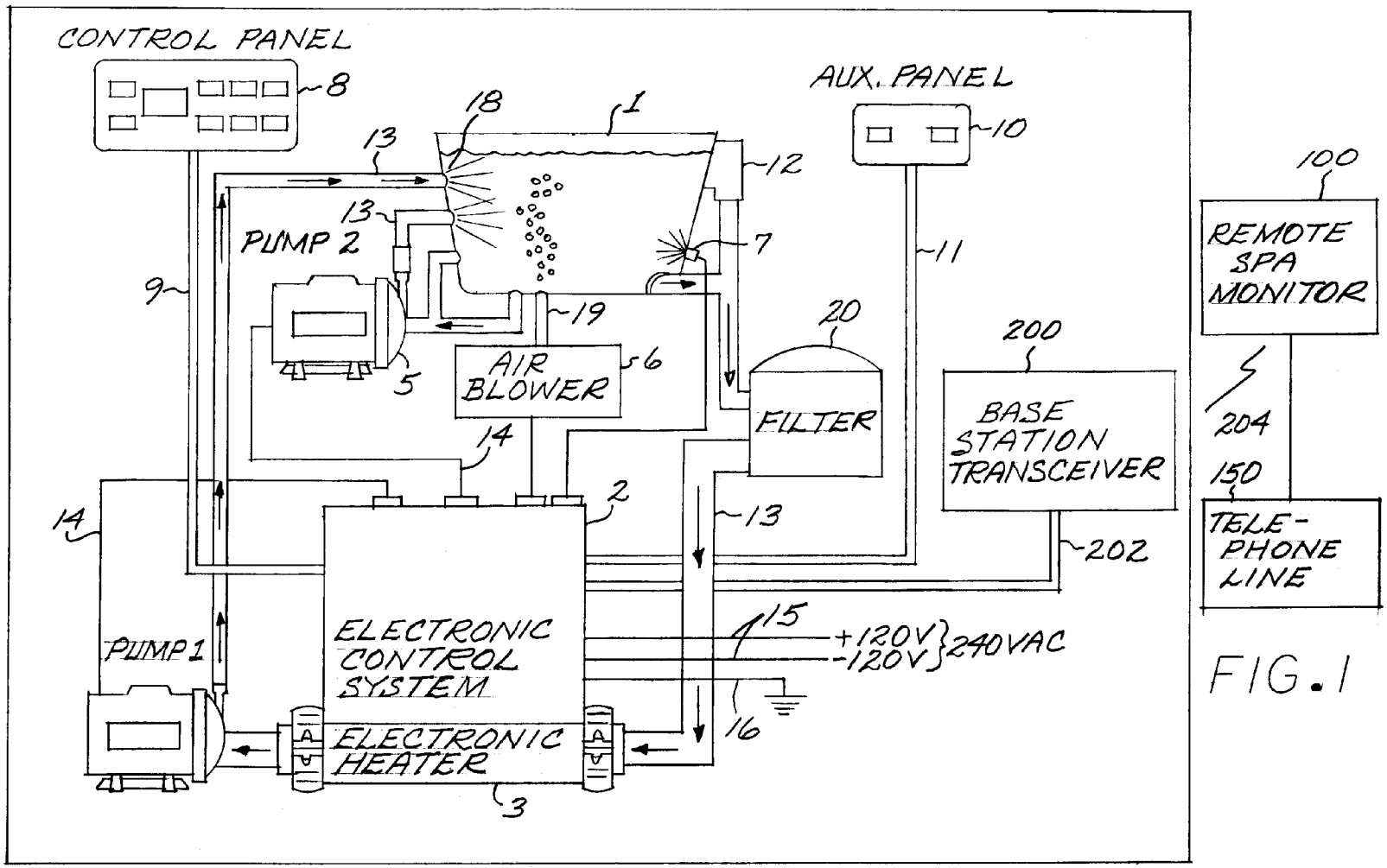
FIG. 1 is a diagrammatic diagram of an exemplary embodiment of a spa system with a remote spa monitor system.

In the following detailed description and in the several figures of the drawing, like elements are identified with like reference numerals.

In an exemplary embodiment, a spa monitor provides a means of monitoring the condition of a spa from inside the owner's house. This may be especially important during times when the spa is left unattended for extended periods of time and a failure could cause the spa to either freeze or overheat. The spa monitor may also control temperature, lights, and jets without having to walk outside. In an exemplary embodiment, a spa monitor system comprises a device, which may be portable, that communicates with a spa over a two-way RF link to watch for abnormal conditions. Upon detecting over-temperature, freeze condition, loss of power, or other abnormal conditions, an exemplary embodiment of the spa monitor device will sound an alarm to notify the owner of the issue. The spa monitor device optionally also has buttons to raise or lower the spa set temperature, turn on or off a light in the spa, or control a jets pump. An LCD display on the spa monitor may display the temperature of the water in the spa or other relevant spa information. LEDs on the display may indicate such status information as, by way of example, whether the spa light is on, whether the jets pump is on, whether the spa is actively heating the water, and whether the remote spa monitor batteries need to be replaced. When no buttons are pressed for a predetermined period of time, the spa monitor may enter a low power mode to conserve battery life. When in low power mode, the spa monitor periodically (no more than once per hour in an exemplary embodiment) transmits an interrogation to the spa and then turns on its receiver to listen for alarm conditions. Pressing any button on the front of the spa monitor wakes the device from low power mode.

FIG. 1 illustrates an overall block diagram of an exemplary embodiment of a spa system with a spa monitor. The system includes a spa 1 for bathers with water, and a control system 2 to activate and manage the various parameters of the spa. Connected to the spa 1 through a series of plumbing lines 13 are pumps 4 and 5 for pumping water, a skimmer 12 for cleaning the surface of the spa, a filter 20 for removing particulate impurities in the water, an air blower 6 for delivering therapy bubbles to the spa through air pipe 19, and an electric heater 3 for maintaining the temperature of the spa at a temperature set by the user. The heater 3 in this embodiment is an electric heater, but a gas heater can be used for this purpose also. Generally, a light 7 is provided for internal illumination of the water.

Service voltage power is supplied to the spa control system at electrical service wiring 15, which can be 120V or 240V single phase 60 cycle, 220V single phase 50 cycle, or any other generally accepted power service suitable for commercial or residential service. An earth ground 16 is connected to the control system and there through to all electrical components which carry service voltage power and all metal parts. Electrically connected to the control system through respective cables 9 and 11 are the control panels 8 and 10. All components powered by the control system are connected by cables 14 suitable for carrying appropriate levels of voltage and current to properly operate the spa.

Water is drawn to the plumbing system generally through the skimmer 12 or suction fittings 17, and discharged back into the spa through therapy jets 18.

The particular equipment for a spa installation will depend on the particular implementation, and not all devices illustrated in FIG. 1 may be installed for some implementations.

A monitoring system is provided for remotely monitoring the spa status. In an exemplary embodiment, the system comprises a remote spa monitor panel 100 and a base station transceiver 200. Communication to and from the spa monitor panel 100 for this exemplary embodiment is through an RF link 204 to the transceiver module 204.

The transceiver module 200 is interfaced to the spa controller 2 so that data and commands can be communicated to the spa controller from the remote spa monitor. In an exemplary embodiment, the transceiver module 200 may be interfaced to the spa controller 2 via an RS485 interface. A cable 202 from the transceiver 200 may plug into a main-panel connector on the electronic controller circuit board. In an exemplary embodiment, the transceiver receives its power from the controller board via this interface. 9.2 volts DC (up to 100 mA) is provided for this embodiment, and can be regulated down to needed voltage(s).

Figure 2A:
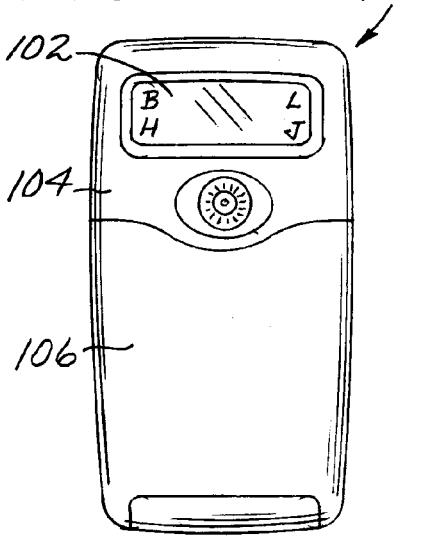
FIG. 2A is a simplified front view of an exemplary embodiment of a spa monitor panel with its front cover closed.
Figure 2B:
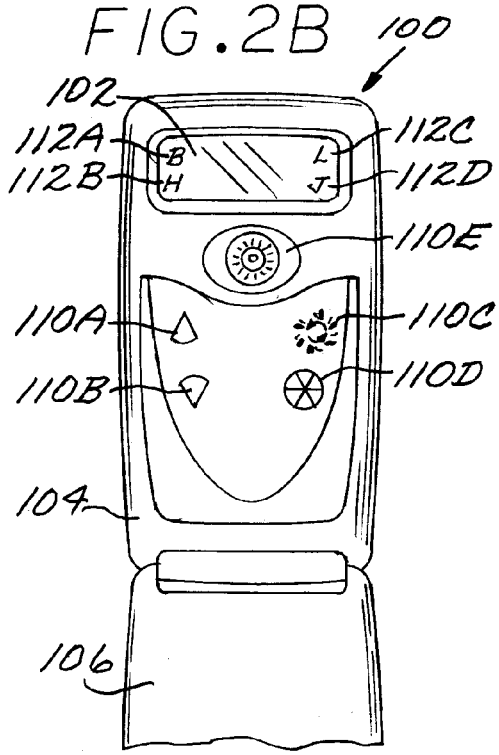
FIG. 2B illustrates the exemplary embodiment with its front cover opened.

The spa monitor panel 100 in an exemplary embodiment is a small portable unit that can be mounted on a wall inside the spa owner's home. FIGS. 2A and 2B illustrate features of an exemplary embodiment of the spa monitor panel 100. This exemplary embodiment includes a panel display 102, a housing 104 comprising a hinged flip-down cover 106, which can be opened to expose several control buttons 110. A custom wall plate may be provided for mounting the spa monitor to a wall. In an exemplary embodiment, the spa monitor panel may be easily be removed from the wall plate by lifting and pulling forward.

In an exemplary embodiment, the spa monitor panel may be designed for in-house use, and is rugged, water resistant, but may not be waterproof. In another embodiment, the spa monitor panel may be adapted for outside use, with waterproofing. In an exemplary embodiment, the spa monitor panel is battery powered, and may be powered with three replaceable AAA batteries. The panel may indicate a low battery condition when the batteries should be replaced.

In an exemplary embodiment, the spa monitor panel 102 is an LCD display, e.g. a three-digit, seven-segment LCD display, to indicate the temperature of the water in the spa or other relevant information. A back light may be included to illuminate the LCD display whenever it is active. In an exemplary embodiment, the spa monitor emits an audible alarm sound if a condition exists in the spa for which the owner needs to be alerted. In an exemplary embodiment, buttons 100 110A-E may be provided on the front of the spa monitor panel, e.g., "jets1" 110C, "temp up" 110A, "temp down" 110B, "light" 110E and "mode" 110D. Pushing either the temp up or temp down button adjusts the set temperature of the spa. In an exemplary embodiment, an LED indicator 112B is provided and is illuminated whenever the spa is actively heating the water. The light button controls a light in the spa. An LED indicator 112C on the spa monitor panel may be illuminated if the spa light is on. The jets button turns on pump 1 in the spa. An LED 112D indicates that pump 1 is on. An LED 112A provides an indication of a low battery condition. In an exemplary embodiment, the LEDS will only be activated while the spa monitor is in an "awake" mode.

Figure 3:
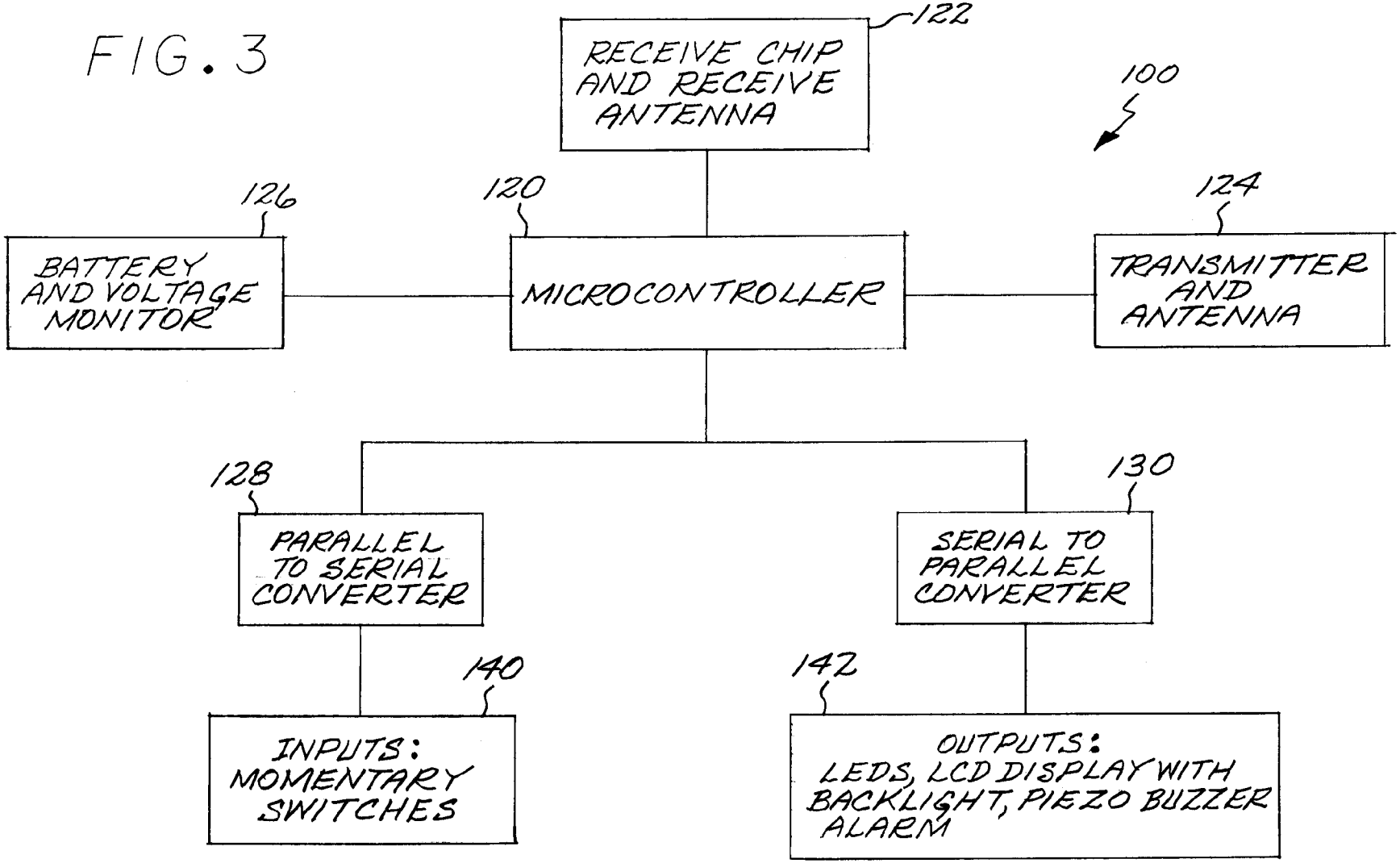
FIG. 3 illustrates a schematic block diagram of electronic components of an exemplary embodiment of a spa monitor panel.

FIG. 3 illustrates a schematic block diagram of electronic components of an exemplary embodiment of a spa monitor panel 100. The spa monitor panel includes a microcontroller 120, which may be a microprocessor. In other embodiments, the microcontroller 120 may be implemented by discrete logic circuitry, or by an ASIC. The panel has wireless receive and transmit capability, and comprises a receive circuit chip and receive antenna collectively illustrated as block 122. A transmitter circuit and antenna is collectively illustrated as block 124. The receiver (block 122) and transmitter (block 124) are electrically connected to ports of the microcontroller 120. A battery and battery voltage monitor is shown as block 126. The microcontroller also receives input commands from the panel buttons, shown collectively in FIG. 3 as block 140 which characterizes the buttons 110A-E of FIG. 2B in this embodiment, through a parallel to serial convertor 128. The microcontroller controls the output display (LCD panel 102 and LEDs 112A-112D), backlight and audible alert device 118 (which is a piezoelectric buzzer device in one exemplary embodiment) through a serial to parallel converter 130 in this embodiment.

Figure 4:
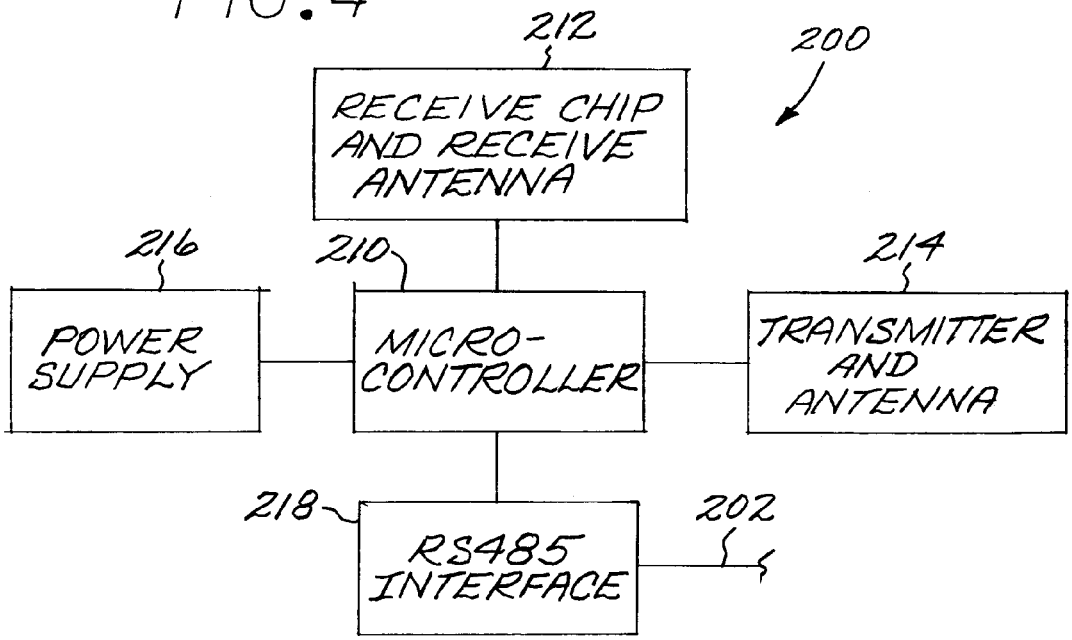
FIG. 4 is a simplified schematic block diagram of electrical elements of an exemplary embodiment of the base station transceiver.

FIG. 4 is a simplified schematic block diagram of electrical elements of an exemplary embodiment of the base station transceiver 200. The base station transceiver 200 in this exemplary embodiment includes a microcontroller 210, which may be a microprocessor. In other embodiments, the microcontroller 210 may be implemented by discrete logic circuitry, or by an ASIC. The transceiver provides wireless receive and transmit capability, and comprises a receive circuit chip and receive antenna collectively illustrated as block 212. A transmitter circuit and antenna is collectively illustrated as block 214. The receiver (block 212) and transmitter (block 214) are electrically connected to ports of the microcontroller 210. The transceiver 200 includes a power supply circuit 216, which provides power for the circuits 210, 212 and 214 developed through the RS485 interface 218. A cable 202 connects the RS 485 interface to the spa electronic control system 2 (FIG. 1). A serial data stream can be passed between the transceiver 200 and the spa controller system 2, allowing data and commands to be passed from the transceiver 200 to the spa controller, and for status and other data to be passed from the spa controller to the transceiver 200. In this manner, commands may be passed from the spa monitor panel 100 via the RF link 204 to the transceiver 200 and on to the spa electronic control system 2, and status data may be passed from the spa electronic control system 2 to the spa monitor panel 100.

Interface of spa control panels such as control panel 8 to the spa electronic control system via an RS-485 interface has been implemented in the past, e.g. in an EL series of spa controllers marketed by Balboa Instruments, Inc. The spa control system may be adapted to recognize the base station transceiver as another control panel, over the RS-485 interface.

In one exemplary embodiment, the remote spa monitor 100 is preferably mounted in a location where it receives a strong signal from the base transceiver module 200. This will ensure that if a noteworthy problem occurs at the spa, the SpaMonitor will be able to alert the homeowner. In an exemplary embodiment, a signal quality test is incorporated in the spa monitor panel, and can easily be activated by the homeowner. An exemplary installation procedure includes the following:

1. Find a suitable location for mounting the remote spa monitor. The location should be convenient for the homeowner, while as close to the spa as practical. The spa monitor panel is preferably not mounted near heat sources (such as radiators, air ducts and sunlight), areas of excessive moisture (such as a bathroom), television sets (and other electronic equipment), cordless telephones, personal computers, microwave ovens, electric motors and other wireless devices.
2. Hold the spa monitor panel in the approximate location it would be mounted.
3. Hold the JETS and LIGHT buttons down at the same time for about 6-9 seconds. This initiates a signal quality measurement technique. A number will be displayed. Release both buttons. If the number displayed is a predetermined number or character, say 24 for this example, this is a good location for mounting the spa monitor panel. If the number is 23 or less for this example, a better location should be found. In an exemplary embodiment, an indication of signal quality is measured by sending out a predetermined number of packets, e.g. 24, of test messages from the spa monitor panel 100 to the transceiver 200, and await each time a response sent back. If a response is received from the transceiver 200 for each test packet, say 24 responses for this example, the number 24 is displayed, indicating good signal quality. In general, the installation location is moved closer to the spa, and away from obstacles that may block the signal such as metal appliances, bathroom plumbing, etc.

In an exemplary embodiment, if the monitor panel is in low power mode, pressing any button will bring the monitor panel out of low power mode without performing the normal function of the button pressed; the button press used to wake up the spa monitor panel will not send a command to the spa. In an exemplary START UP sequence, the user may push any button to wake up the spa monitor panel if the display is blank. Once the spa monitor panel is awake, the LCD and LED indicator icons will display the status of the spa. The remote spa monitor can send commands to the spa with button presses similar to those of the main spa panel. The user is to wait for the button press to take effect. There is a small delay as the signal is passed from the spa monitor panel to the spa and a response is verified. In an exemplary embodiment, the spa monitor panel will stay "awake" for a predetermined time interval, e.g. 15 seconds, after the last button press in an exemplary embodiment, and thereafter enter the low power mode to conserve battery power.

The spa monitor panel may have an optional configuration that has a built in phone jack for connecting to a phone line 150 (FIG. 1). This feature automatically dials a predetermined phone number and leaves a voicemail alert if any alarm condition is detected in the spa. If there is a problem connecting with the phone number, a secondary number may be dialed. This feature is intended for spas in homes or cabins that are unoccupied for extended periods of time. The spa monitor panel may include a means of entering the phone numbers by utilizing the buttons on the panel and a means of enabling or disabling this feature. Alternatively, the spa monitor panel can include a portable wireless or cell telephone to communicate with the telephone system over a wireless connection.

Figure 5:
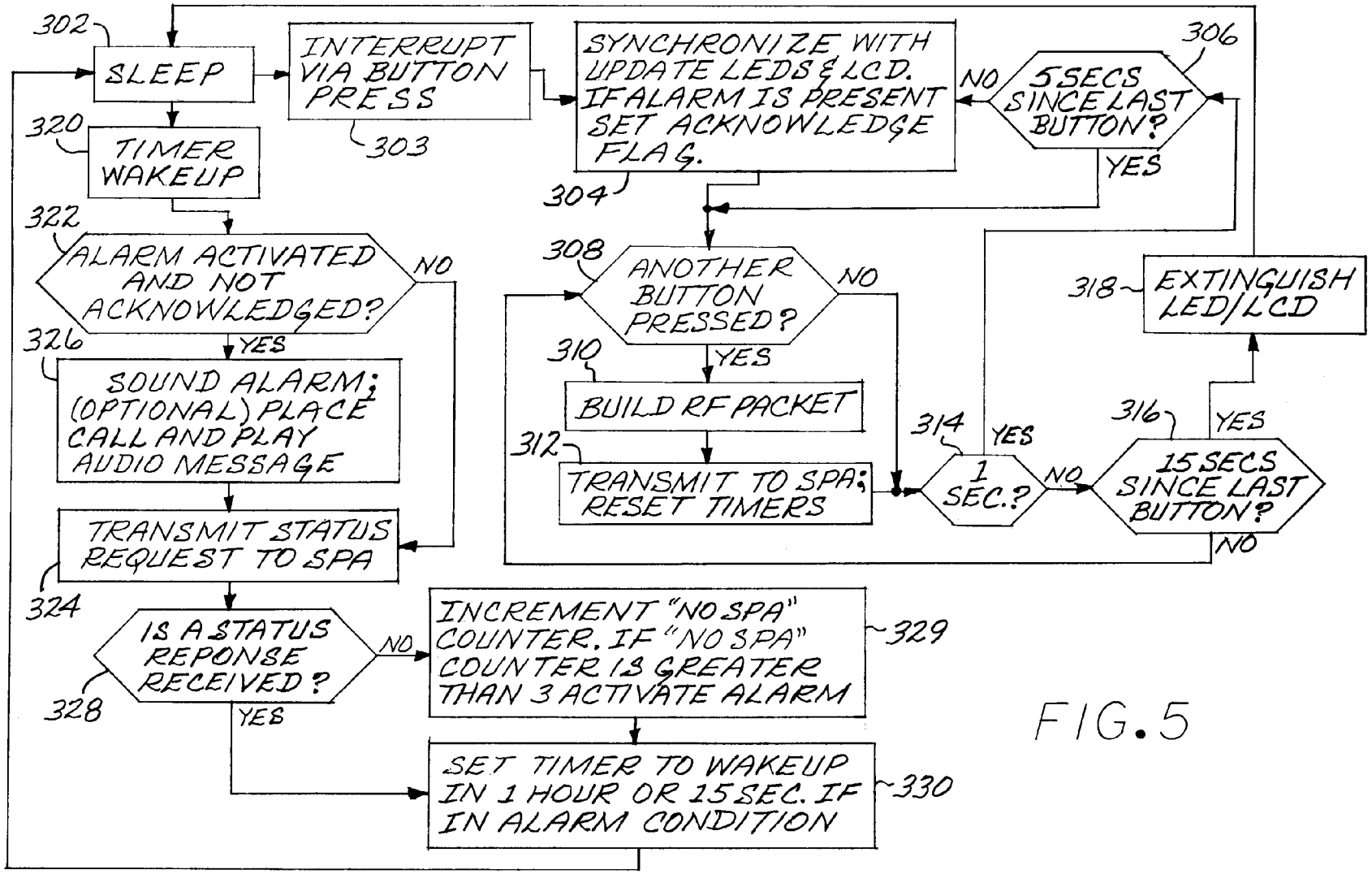
FIG. 5 is a flow diagram illustrating an exemplary method of operation of the spa monitor panel.

FIG. 5 is a flow diagram illustrating an exemplary method 300 of operation of the spa monitor panel, which in an exemplary embodiment may be implemented by programming the microcomputer 120. The panel is normally in the low power, or "sleep" mode, at 302. The low power mode may be interrupted by a button press, at 303, followed at 304 by a communication with the transceiver module 200 to synchronize the spa monitor panel with the status of the spa. The LEDs and LCD panel display are also updated at this step. If an alarm condition is present, an acknowledge flag is set. In an exemplary embodiment, the remote spa monitor panel will receive similar status information to that which is presented at the spa control panel 8, or a subset of the status information. In an exemplary embodiment, the alarm conditions include failed water flow, temperature sensor imbalance over an extended period, dry heater condition, spa overheat, heater overheat, sensor fault A (e.g. an inlet heater temperature sensor), sensor fault B (e.g. an outlet heater temperature sensor), and a safety fault, which may result from a sensor indicating a spa problem, such as, by way of example only, a suction sensor indicating a high vacuum or blockage in a pump intake. If another button is pushed at 308, indicating a command has been entered by the user on the panel 100, an RF packet is built at 310. The RF packet is transmitted to the transceiver 200 and spa at 312 using the RF link, and a timer is reset. If another button has not been pushed at 308, operation proceeds to 314. At 314, the timer is tested. If more than 1 second has elapsed since the last button was pressed, operation proceeds to 306, and step 304 is repeated if less than 5 seconds has elapsed since the last button push. If more than 5 seconds have elapsed, operation proceeds to step 308. If at 314, less than one second has elapsed since the timer was reset, operation proceeds to 316, where the timer is checked to determine whether 15 seconds has elapsed since the last button push. If yes, operation proceeds to 318, where the display is extinguished, and then to the sleep mode 302. If not, operation returns to 308.

Another way to interrupt the low power mode is by a sleep timer wakeup 320. At timer wakeup, the controller tests (322) to determine whether an alarm condition has been activated and not acknowledged by the user at the remote spa panel. Acknowledgment can be a button push on the remote spa monitor panel. If yes, at 326, the alarm at the spa panel will be activated, making an audible alarm sound through the piezoelectric buzzer to alert the spa owner inside the house. The spa monitor panel may optionally place a telephone call to a predetermined number or numbers, and play an audio message indicating the alarm condition. Operation proceeds to 324, to transmit a command to the spa controller through the RF link and the transceiver 200 for a status check. Up to some predetermined number of status queries will be sent, e.g. 12, until a response is received from the transceiver 200 or until the predetermined number of status queries have been sent. If a status response is not received at 328 in response to the status queries, then at 329, a "No Spa" counter is incremented. If the "No Spa" counter value is greater than some predetermined number, say 3 in this example, then a "No Spa" alarm is activated. This alarm condition results from no response to repeated status queries, and is taken as an indication that the spa has lost or been terminated from electric power. This is a condition which may lead to damage, e.g. in winter climates. In an exemplary embodiment, the No Spa alarm is not activated until some predetermined number of consecutive timer wake up cycles have passed without receiving status query responses. Since in this example, each cycle includes up to 12 status queries sent, then the No Spa alarm will not be activated until 48 status queries have been sent consecutively without receiving a response. Of course, the number of cycles and queries per cycle sent without response may vary, depending on the application.

If a status response is received at 328, then the timer is set to wakeup in one hour, or in 15 seconds if in alarm condition, at 330, and operation returns to the sleep mode at 302.

In an exemplary embodiment, the spa monitor panel communicates with the base station transceiver module over an RF link 202, e.g. at 433.92 MHz. The spa monitor panel and transceiver module 200 have a large number of possible address codes so that interference with neighborhood spas with a similar system is statistically extremely unlikely.

An exemplary protocol for the RF data packets is set out below.

| Base Station | | | Spa Monitor Panel | | |
|---|---|---|---|---|---|
| Preamble (on) | 16 | Te | Preamble (on) | 16 | Te |
| Preamble (off) | 16 | Te | Preamble (off) | 16 | Te |
| Header | 4 | Te | Header | 4 | Te |
| Start Bit | 2 | Te | Start Bit | 2 | Te |
| Unit ID | 4 | bits | Unit ID | 20 | bits |
| Device ID | 4 | bits | Device ID | 4 | bits |
| Message ID | 4 | bits | Message ID | 4 | bits |
| PAYLOAD | 45 | bits | PAYLOAD | 12 | bits |
| Encryption | 4 | bits | Encryption | 4 | bits |
| Checksum | 4 | bits | Checksum | 4 | bits |
| Hamming | 7 | bits | Hamming | 6 | bits |
| Message Bits | 72 | bits | Message Bits | 54 | bits |
| Te 0.175 | ms | | | | |

An exemplary payload data structure is shown below.

| From Spa Monitor | | From Base Station | | |
|---|---|---|---|---|
| Message ID 0: Status Request Payload | | Message ID 0: Status Request Payload | | |
| (placeholder) | 12 | LSB | displayMode | 3 |
| total bits | 12 | | alarm | 1 |
| | | | LCD | 18 (truncated ascii) |
| | | | modes | 3 |
| | | | decimalPoint | 1 |
| | | | heatOn | 1 |
| | | | lightSpeed | 2 |
| | | | pump1Speed | 2 |
| | | | pump2Speed | 2 |
| | | | pump3Speed | 2 |
| | | | blowerSpeed | 2 |
| | | | messageCode | 7 |
| | | MSB | requestTime | 1 |
| | | | total bits | 45 |
| Message ID 1: Command Entered Payload | | Message ID 1: Command Entered | | |
| (placeholder) | 4 | [same as Status Request] | | |
| buttonCode | 8 | | | |
| total bits | 12 | | | |
| Message ID 2: Linking Change Payload | | Message ID 2: Linking Response Payload | | |
| Add new | 1 | ADD success | | 1 |
| Clear local | 1 | Clear success | | 1 |
| Clear global | 1 | Global Clear succces | | 1 |
| (placeholder) | 1 | (placeholder) | | 1 |
| Protocol Rev | 4 | 8 bits of serial number | | 8 |
| (placeholder) | 4 | # remotes learned | | 4 |
| total bits | 12 | Protocol Rev | | 4 |
| | | Seconds after POR | | 16 |
| | | (placeholder) | | 9 |
| | | total bits | | 45 |
| Message ID 3: Request Time Payload | | Message ID 3: Time Response Payload | | |
| (placeholder) | 12 | # seconds to ready | | 16 |
| total bits | 12 | (placeholder) | | 29 |
| | | total bits | | 45 |
| Message ID 4: Manf. Date Code Payload | | Message ID 4: Manf. Date Code Payload | | |
| (placeholder) | 12 | Year | | 4 |
| total bits | 12 | Week of year | | 6 |
| Message ID | 5-15 | (placeholder) | | |
| | | total bits | | 10 |
| | | unused | | |

In an exemplary embodiment, each spa monitor ships from the factory set to a unique address. A means may be provided for the transceiver module 200 to learn the address code of the spa monitor panel when the system is first installed. In an exemplary embodiment, the transceiver is capable of learning the addresses of a plurality of spa monitor panels, e.g. six addresses, so that a plurality of panels may installed throughout a house for monitoring and controlling the spa. In an exemplary embodiment, the transceiver module 200 enters learning mode whenever the unit is powered up and remains in learning mode for a time interval, e.g. approximately 30 seconds. Alternatively, other address schemes may be employed, e.g. setting DIP switches on each of the respective transceiver module and the spa monitor panel to the same address.

In an exemplary embodiment, the transceiver module 200 is mounted close to the spa electronic control system 2, e.g. under the skirt of the spa. In an exemplary embodiment, the transceiver module 200 is designed for screw mounting to the structure of the spa, and its enclosure is preferably designed to be water resistant in case water leaks under the spa. The transceiver module is coupled to the spa controller, and in an exemplary embodiment receives its power from and communicates with the spa controller via an eight-pin cable 202, which plugs into a main panel jack on the controller board of the controller 2.

In an exemplary embodiment, the transceiver module antenna is capable of transmitting the RF signal from its location to the spa monitor panel, e.g., located up to 100 feet away inside a house.

Figure 6B:
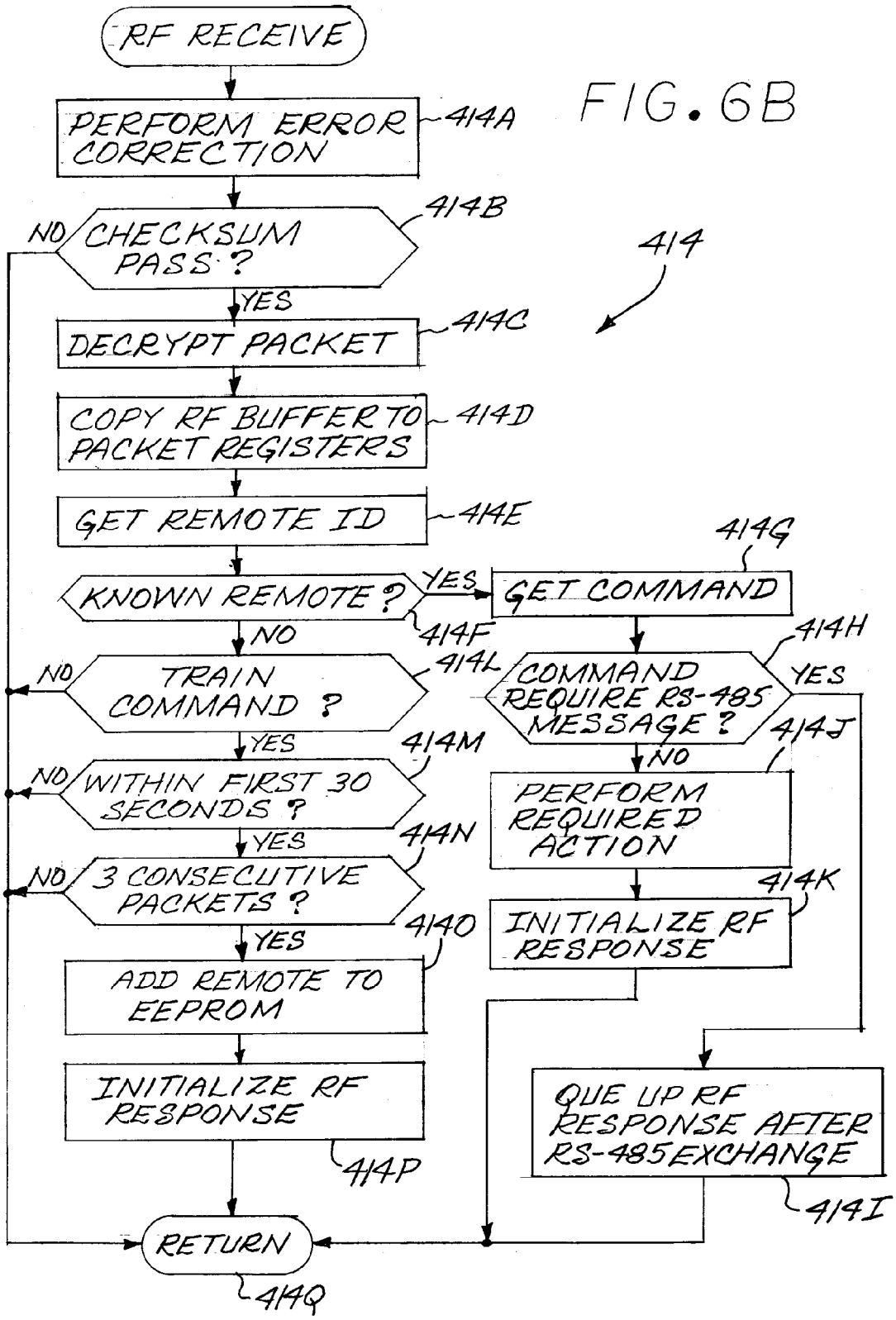

FIGS. 6A-6D depict an exemplary process flow for an exemplary embodiment of a transceiver module 200. FIG. 6A depicts an exemplary main loop of the process. Following power on or reset (402), the system is initialized (404), and a 30 second "train enable" timer is started (406). At 408, the RF receiver is enabled, and at 410, the RS-485 receiver is enabled. If a new RF message is received at 412, the RF Receive routine 414, depicted in further detail in FIG. 6B, is called. If an RS-485 byte is received at 416, the RS-485 Routine, depicted in further detail in FIG. 6C, is called. Step 420 is a decision block for determining whether an RS-485 byte has been sent. If yes at 420, then at 422, if finished with a buffer in the microcontroller which loads the entire message in the buffer, the RS-485 transmit operation is disabled, and receive operation is enabled at 424. If no at 420, the next byte is sent at 426. Step 428 is a test for whether it is time to transmit the next RF bit. If yes at 428, then at 430 if the last bit has been transmitted, RF transmit operation is disabled and receive operation is enabled (432). If the last bit has not been sent the next bit is updated at 434. At 436, a 10 ms timer is tested. If the timer has elapsed, operation proceeds to the "10 ms Timer" routine, depicted in further detail in FIG. 6D. Otherwise, operation returns to 412.

FIG. 6B illustrates an exemplary embodiment of an RF Receive routine 414. At 414A, error correction is performed, and if the checksum does not pass at 414B, operation proceeds to 414Q to return to the main loop. If the checksum does pass, then the RF packet is decrypted at 414C, the RF buffer is copied to packet registers at 414D, and the remote ID is obtained from the packet at 414E. If not a known ID, operation proceeds to 414L, to determine if the packet contains a train command. If there is no train command at 414L, operation returns. If there is a train command, but the timing at 414M is not within the first 30 seconds after power on/reset, operation returns to the main loop. If three consecutive packets have not been received at 414N, operation returns to the main loop. If three consecutive RF packets have been received with the train command, the remote ID is stored in a nonvolatile memory, e.g. an EEPROM, at 414O. RF response is initialized at 414P, and operation returns.

If yes at 414F, the command is fetched from the register at 414G. At 414H, a decision determines whether the command requires an RS-485 message to the spa controller. If yes, then at 414I, after an RS-485 exchange, an RF response is qued up, and operation returns. If no, then at 414J, the required operation is performed at 414J, an RF response is initiated at 414K, and operation returns to the main loop.

FIG. 6C illustrates an exemplary embodiment of the RS-485 routine 418. At 418A, if the panel select line is not low, a progress counter is reset at 418R, and operation returns to the main loop. If yes at 418A, then at 418B, a byte is added to the buffer, and at 418C, the progress counter is incremented. At 418D, a decision is taken as to whether a special test sequence has been entered. If yes, a test mode is entered at 418E. If not, and if not finished receiving the message at 418F, operation returns to the main loop. If finished receiving the message, then the progress counter is reset at 418G, a CRC value is calculated at 418H, and if the value passes, operation proceeds to 418J. Here if a custom text message is received, an RS-485 response is initialized at 418R, and operation returns. If no custom text message has been received, operation proceeds to 418K. If a new command is to be sent, the command is set up at 418L. If no new command, the status registers are updated at 418M, the update counter is cleared at 418N. At 418O, if there is a que for RF messages, an RF response is initialized at 418P. If no que, an RS-485 response is initialized at 418Q, and operation returns.

Figure 6D:
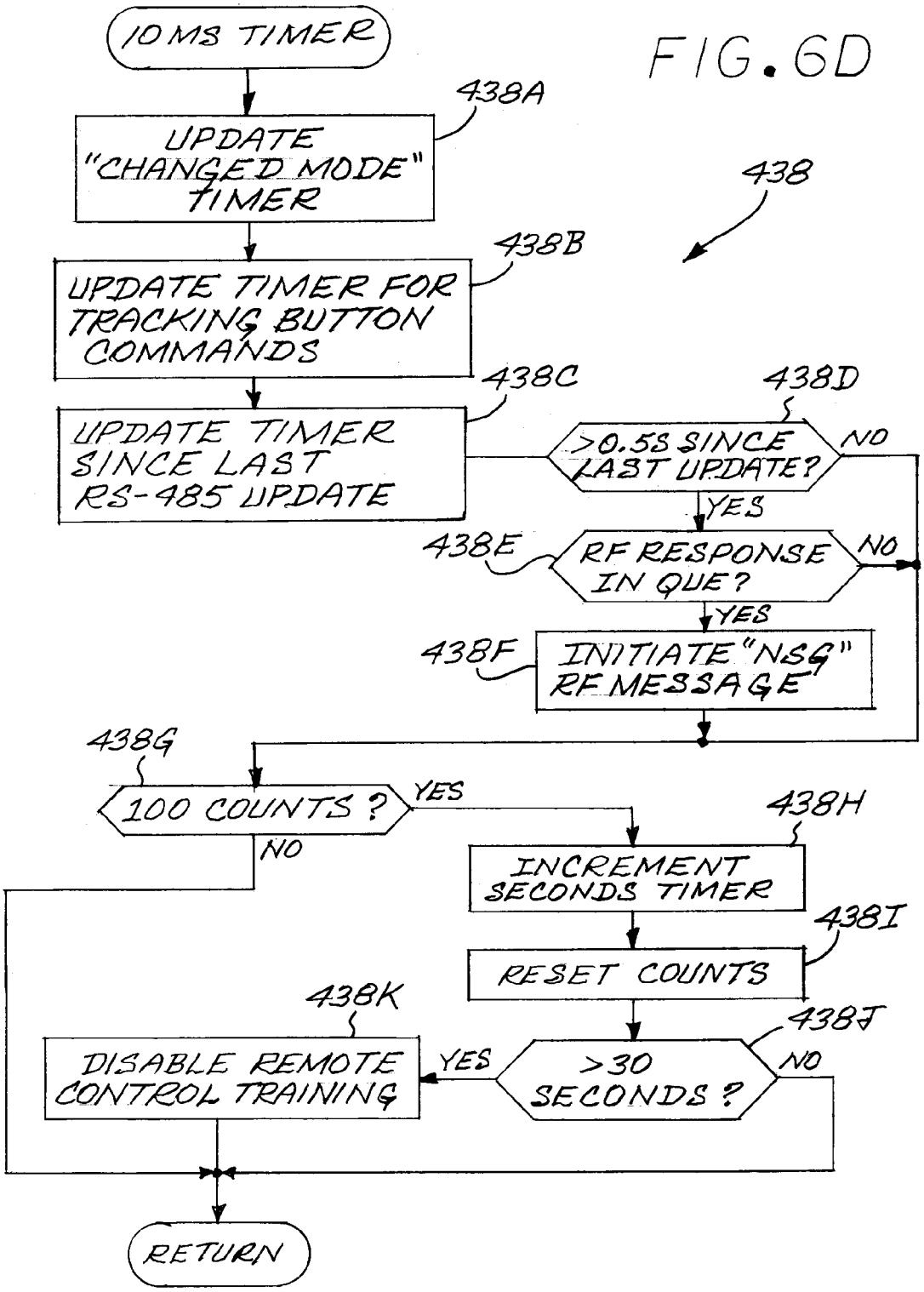

FIG. 6D illustrates an exemplary embodiment of a "10 ms Timer" routine 438, to do operations at a 10 ms interval, e.g. whether any buttons have been pressed, and whether there are any remaining message bytes in the buffer. At 438A, a "changedMode" timer is updated. The timer is updated for tracking button commands at 438B. The timer is updated since the last RS-485 update at 438C. If more than 0.5 seconds has elapsed since the last update (438D), and if an RF response is in que (438E), a "NSG" RF message is initiated at 438F, indicating that no response was received. At 438G, if the timer is at 100 counts, indicating that one second has been counted, the seconds timer is incremented at 438H, the counts is reset at 438I, and if greater than 30 seconds (438J), remote control training is disabled at 438K. Operation returns to the main loop.

Figure 7:
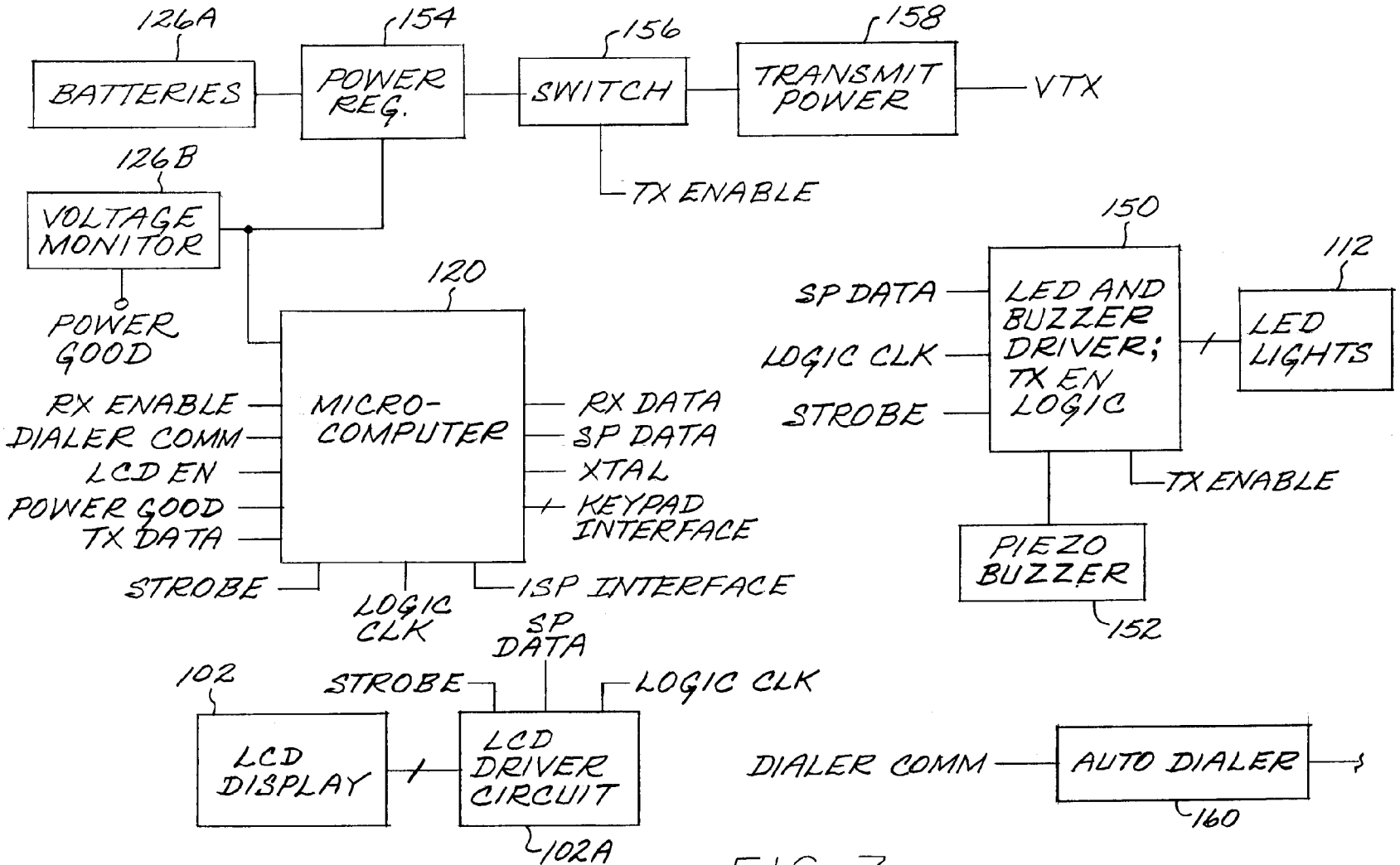
FIG. 7 is a simplified schematic diagram of electrical and control elements of an exemplary embodiment of a spa monitor panel.

FIG. 7 schematically illustrates elements of an exemplary embodiment of a spa monitor panel. In an exemplary embodiment, the panel comprises an electronic controller, e.g. a microcomputer such as, by way of example only, a PIC16F648A microcomputer. The microcomputer is programmed to implement the functions of the panel, e.g. including the processes illustrated in FIG. 5. Programming can be performed on the microcomputer, e.g using a programming station before installing the microcomputer on the printed circuit board of the panel, or an in-system-programming interface may be employed, as shown in FIG. 7, to program the unit 120 while installed on the printed circuit board. ISP techniques may also be used to update a fielded unit's program.

Batteries 126A provide electrical power in this embodiment, although in an alternate embodiment, a wired power source, e.g. a transformer connected to line voltage, may be employed. The battery voltage is regulated by regulator 154, and a regulated output powers the microcomputer 120 and also is monitored by a voltage monitor circuit 126B, which can provide a low power warning using a signal "PWR GOOD" coupled to an input of the microcomputer. A switch 156 controlled by a TX ENABLE signal allows transmit supply voltage (VTX) to be supplied or interrupted to the transmitter circuit (FIG. 8), thereby enabling or disabling transmit operation.

The microcomputer 120 receives button push data from a keypad interface, and controls operation of the LCD display 102 through an LCD driver circuit 102A, by signals SP DATA, LOGIC CLK and STROBE. The microcomputer 120 also controls the LED lights 112 and piezoelectric buzzer element 152, and generates the transmit enable signal (TX ENABLE) through a driver and logic section 150, by the SP DATA, LOGIC CLK and STROBE signals as well.

An optional autodialer circuit 160 may also be included, which is controlled by a data output DIALER COMM from the microcomputer 102. This can control the autodialer to dial a predetermined number, and to send a recorded message, e.g. a message generated by a voice synthesizer circuit or chip.

Figure 8:
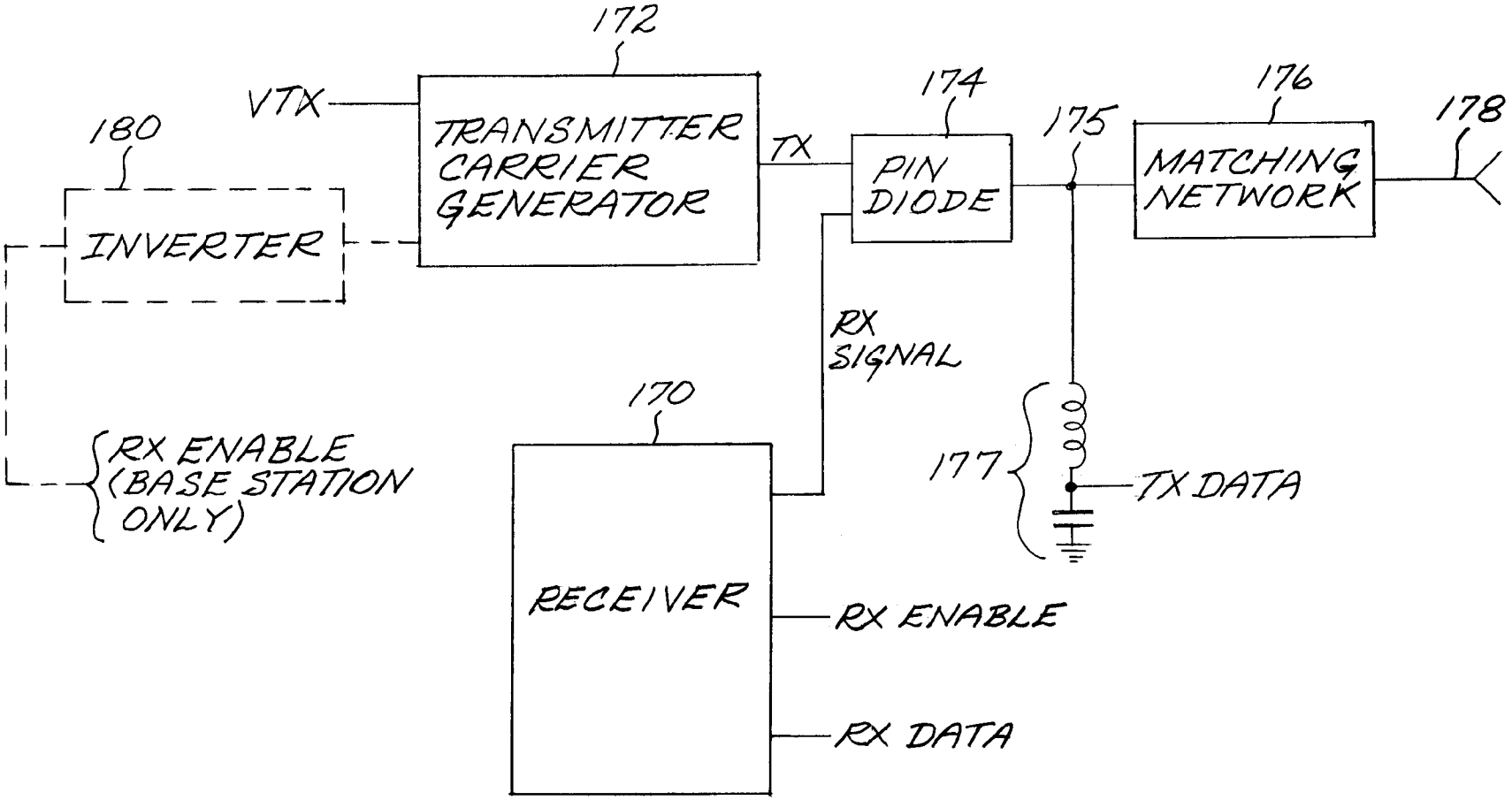
FIG. 8 is a simplified schematic diagram of an exemplary embodiment of a receiver and transmitter section for a spa monitor system.

FIG. 8 schematically depicts a transmitter and receiver section, i.e. a transceiver, which may be employed in an exemplary embodiment to transmit and receive data and commands. This section may be used in the remote spa monitor panel 100, as well as in the base station transceiver 200. This circuit includes a receiver chip, e.g. a Microchip RFRXD0420 device, a superheterodyne receiver device that supports both ASK and FSK modulation formats within a frequency range of 300 to 450 MHz. An exemplary embodiment of the transmitter and receiver section employs ASK (amplitude shift keyed) modulation.

A transmit carrier generator 172 comprises a crystal-controlled oscillator for generating a carrier frequency, in this example at 433.92 MHz. The oscillator circuit is powered by voltage VTX, and so when this voltage is disabled by switch 156, the transmitter operation is disabled. To prevent interference, the transmitter oscillator circuit is disabled during receive operation. An alternate technique to disable the oscillator during receive operation is to invert the RX ENABLE control signal, e.g. by optional inverter 180, and use this inverted signal as a disable signal, e.g. to control a transistor switch. In an exemplary embodiment of the base station transceiver, this alternate technique is employed to disable the transmitter oscillator during receive operation.

The transceiver section of FIG. 8 includes an antenna 178, which may be implemented as a circuit board trace on a printed circuit on which the transceiver circuits are fabricated. An impedance matching network 176 couples the antenna 178 to a steering circuit 174, which in an exemplary embodiment is a PIN diode. The circuit 174 steers the transmit signals to the matching network while isolating the receiver from the transmitter, and steers the received signals to the receiver.

Transmit data is applied to node 175 during transmit operations through an LC circuit 177 to amplitude shift key modulate the transmit carrier. This data is generated by the microcomputer, e.g. microcomputer 120 of the monitor panel 100, or by the microcomputer 210 of the base station transceiver 200. The received signals are passed through the circuit 174 to the receiver for demodulation to provide the received signals at base band, RX DATA, which is in turn passed on to the microcontroller 120 or 210, as the case may be.

Figure 9:
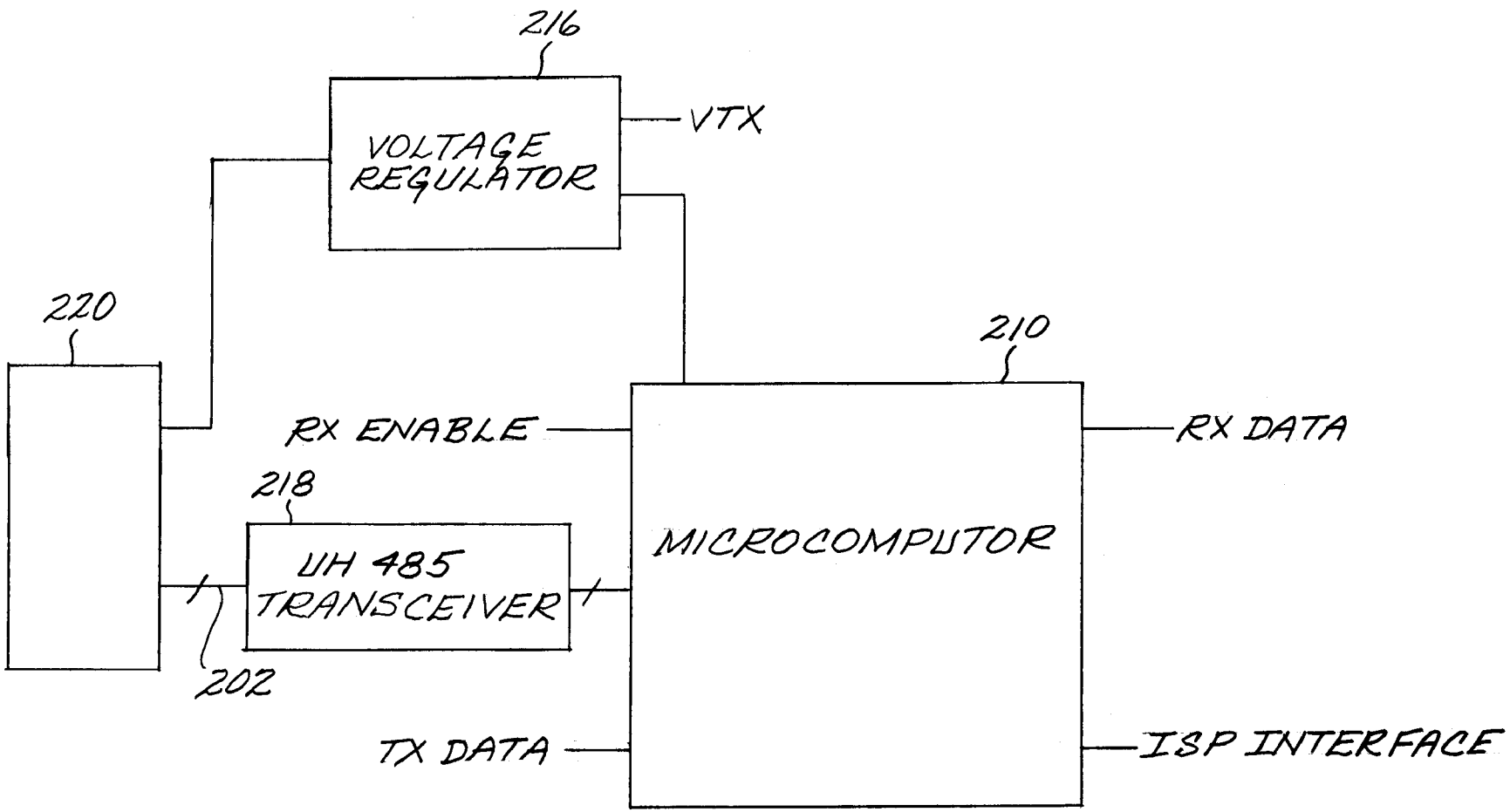
FIG. 9 is a simplified schematic diagram of electrical and control elements of an exemplary embodiment of a base station transceiver.

FIG. 9 illustrates an exemplary embodiment of the control aspects of the base station transceiver 200, and includes an electronic controller, e.g. a microcomputer such as, by way of example only, a PIC16F648A microcomputer. The microcomputer is programmed to implement the functions of the transceiver 200, e.g. including the processes illustrated in FIG. 6A-6D. Programming can be performed on the microcomputer, e.g using a programming station before installing the microcomputer on the printed circuit board of the panel, or an in-system-programming interface may be employed, as shown in FIG. 9, to program the unit 210 while installed on the printed circuit board. ISP techniques may also be used to update a fielded unit's program.

The microcomputer 210 communicates with the spa electronic controller 2 through a data interface, e.g. in an exemplary embodiment an RS 485 interface. An RS-485 transceiver device 218, is connected between ports of the microcomputer 210 and a connector 220, which may connect via cable 202 to a matching connector on the spa electronic controller 2. This permits exchange of commands and data between the controller 2 and microcomputer 210.

Although the foregoing has been a description and illustration of specific embodiments of the invention, various modifications and changes thereto can be made by persons skilled in the art without departing from the scope and spirit of the invention as defined by the following claims.

What is claimed is:

1. A method for remotely monitoring a status of a spa installation including an electronic spa controller, a spa control panel and a tub, the method comprising:

entering a sleep or low power mode of operation of a spa monitor remotely located relative to the spa installation;

at periodic time intervals after entering the sleep or low power mode, automatically transmitting query signals from the spa monitor to the spa installation over a communication link;

activating a spa monitor receiver adapted to receive query response signals from the spa installation over the communication link responsive to said query signals;

entering the sleep or low power mode if status query response signals are received; and generating an alarm under a set of conditions based on query response signals and lack of query response signals received from the spa installation via the communication link, said generating an alarm including generating an alarm indicative of loss of electrical power to the spa installation based on failure to receive query response signals at the spa monitor in response to repeated query signals transmitted to the spa installation.

2. The method of claim 1, further comprising placing the spa monitor in a low power mode subsequent to said activating the receiver.

3. The method of claim 1, wherein said generating an alarm comprises generating an audible alert condition.

4. The method of claim 1 wherein said generating an alarm comprises sending a message over a telephone link.

5. The method of claim 1 wherein said transmitting query signals comprises transmitting said query signals from the spa monitor located within a house or other structure in an interior location to the spa installation disposed in an outdoor location.

6. The method of claim 1, wherein said generating an alarm comprises activating a visual display.

7. The method of claim 6, wherein said activating a visual display comprises activating a visual display indicating a particular alarm condition.

8. The method of claim 1, further comprising testing for signal link quality over said communication link, and generating an indication of the signal quality.

9. The method of claim 8, wherein said testing for signal link quality comprises:

sending a predetermined number of queries over said communication link;

receiving responses to said queries from said spa installation; and determining a signal quality from said responses.

10. The method of claim 8, wherein said determining a signal quality from said responses includes:

determining whether a response was received to each of said predetermined number of queries.

11. The method of claim 1, wherein said generating an alarm further includes:

generating an alarm as a result of receipt of query response signals indicative of an over-temperature condition or a freeze condition at the spa installation.

12. The method of claim 1, wherein the communication link is a wireless communication link.

13. A remote spa monitor system for a spa installation including an electronic spa controller, the remote spa monitor system comprising:

a base station transceiver connected to the electronic spa controller through an interface allowing transmission of commands and data between the transceiver and the electronic spa controller; and a spa monitor remotely located relative to the spa installation, the spa monitor for communicating with the base station transceiver, said spa monitor comprising a monitor receiver and an electronic controller adapted to periodically send query signals to the base station transceiver, monitor the monitor receiver for query response signals from the base station transceiver, and generate an alarm under a set of conditions based on query response signals and lack of query response signals received from the spa; and wherein said set of conditions includes repeated lack of query response signals from the base station transceiver in response to a plurality of successive periodic query signals, the spa monitor electronic controller configured to interpret said repeated lack of query response signals as indicative of a loss of electrical power to the spa installation.

14. The system of claim 13, further comprising a sound generator, and wherein the spa monitor electronic controller is adapted to control the sound generator to generate the alarm.

15. The system of claim 13, further comprising a telephone dialer device, and wherein the spa monitor electronic controller is adapted to control the telephone dialer device to send an alarm message over a telephone link.

16. The system of claim 13, wherein said spa monitor is located within a house or other structure in an interior location.

17. The system of claim 13, wherein the spa monitor comprises an indicator light, and wherein the monitor electronic controller is adapted to control the indicator light to indicate an alarm condition.

18. The system of claim 13, wherein said spa monitor electronic controller is configured to generate an alarm as a result of receipt of query response signals indicative of an over-temperature condition or a freeze condition at the spa installation.

19. The system of claim 13, wherein the base station transceiver and the monitor receiver provide a wireless communication link.

20. The system of claim 13, wherein the spa monitor electronic controller is configured to place the spa monitor in a sleep or low power mode, and after entering said mode to periodically send said query signals to the base station transceiver.

* * * * *